United States Patent [19]

Tsukuru

[11] 4,138,710

[45] Feb. 6, 1979

[54] IGNITION DEVICE

[76] Inventor: Mizoguchi Tsukuru, 660-106, Kanmatsu-cho, Kishiwada-shi, Osaka, Japan

[21] Appl. No.: 592,750

[22] Filed: Jul. 3, 1975

[30] Foreign Application Priority Data

Nov. 6, 1974 [JP] Japan ..... 49-128217

[51] Int. Cl.[2] ..... F02P 9/00

[52] U.S. Cl. ..... 361/263; 123/148 E; 315/214

[58] Field of Search ..... 317/96, 79; 123/148 E, 123/148 CC; 315/214, 215, 217, 224; 307/318; 361/263

[56] References Cited

U.S. PATENT DOCUMENTS

| | | | |
|---|---|---|---|
| 2,589,164 | 3/1952 | Tognola | 317/96 X |
| 2,643,284 | 6/1953 | Putnam | 317/96 X |
| 2,789,254 | 4/1957 | Bodle et al. | 307/318 |
| 2,797,252 | 6/1957 | Erikson | 315/214 X |
| 2,879,451 | 3/1959 | Sherwood et al. | 315/215 |
| 3,293,492 | 12/1966 | Wald | 315/214 X |
| 3,878,824 | 4/1975 | Haubner et al. | 128/148 E |
| 3,900,017 | 8/1975 | Collins | 123/148 E |
| 3,926,557 | 12/1975 | Callies et al. | 123/148 E |

*Primary Examiner*—J. V. Truhe
*Assistant Examiner*—Clifford C. Shaw
*Attorney, Agent, or Firm*—Browdy and Neimark

[57] ABSTRACT

An ignition device for an internal combustion engine such as an engine for a motorcar. This ignition device contains at least one avalanche diode which is connected between the ignition coil and the distributor and therefore does not allow current to flow to the distributor unitl a certain voltage is attained.

5 Claims, 5 Drawing Figures

Element Characteristic

Sparking Voltage – Time Relationship by Motorscope

IGNITION DEVICE

FIELD OF THE INVENTION

The present invention relates to an ignition device for an internal combustion engine such as an engine for a motorcar.

SUMMARY OF THE INVENTION

The present invention relates to an inexpensive, compact, durable and reliable ignition device which generates a stable high-sparking voltage with short residual sparking voltage time, and can easily be attached to older cars without limiting the attaching position. This device contains at least one avalanche diode which is connected between the ignition coil and the distributor and therefore does not allow current to flow to the distributor until a certain voltage is attained.

Due in large part to the addition of this avalanche diode, the present invention has the following advantages:

1. Perfect ignition can be obtained, even though airfuel ratio increases 10 to 15 percent.
2. Temperature of exhaust gas decreases to lengthen the life of muffler.
3. Mileage increases.
4. Wearing of battery decreases.
5. Noise of engine becomes silent. Vibration of engine decreases to lengthen the life of car and to give confortable drive.
6. Starting takes place even in high humidity.
7. Plug is not stained by carbon.

DESCRIPTION OF THE DRAWINGS

FIGS. 6–8 are respectively schematic diagrams of a second, a third and a fourth embodiment of ignition devices according to the present invention.

DETAILED DESCRIPTION OF THE INVENTION

Figure 1:
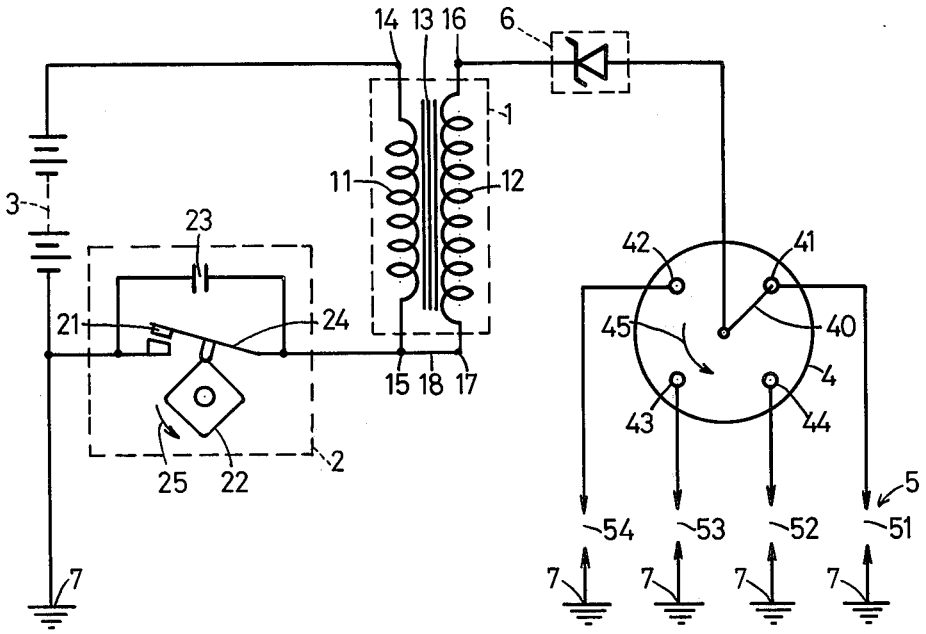
FIG. 1 shows a circuit of this invention.

This invention was made by comparing the conventional battery type ignition device which does not have element 6 in FIG. 1, with an ignition device which is connected with a diode in series between the positive voltage side of a secondary coil and a distributor, and was found to have excellent properties as a result of examinations under various conditions.

Voltage required for spark discharge, generally, depends upon the shape of ignition plug electrode, gap length, temperature of electrode, and, ratio, pressure, and moisture of mixed gas, as well as starting and running conditions. Heretofore, the minimum voltage required for spark discharge at starting was about 1.6–2 times of that at running. In four cylinders, or a plurality of cylinders sparking voltage, commonly, shows variation as illustrated by the solid line in FIG. 3. If any peak voltage value P1, P2, P3 or P4 is under the minimum voltage at starting, misfiring occurs which causes an irregular revolution of the engine, engine and parts to become warm, and consequently an uncomfortable drive. If many peak voltage values are under the minimum voltage, starting does not occur. If the sparking voltage is not sufficiently higher than the minimum voltage at starting and running, discharge does not occur under conditions such as the moisture content being high in mixed gas on rainy day, or the air-fuel ratio varies owing to some reasons. The sparking voltage is desirable to take such wave form as to rise suddenly when point 21 turns to off from on, accompanied by a revolution of contact breaker can 22, and to decrease suddenly after the maximum sparking voltage is attained, and, consequently, residual voltage time is preferably short.

Figure 2:
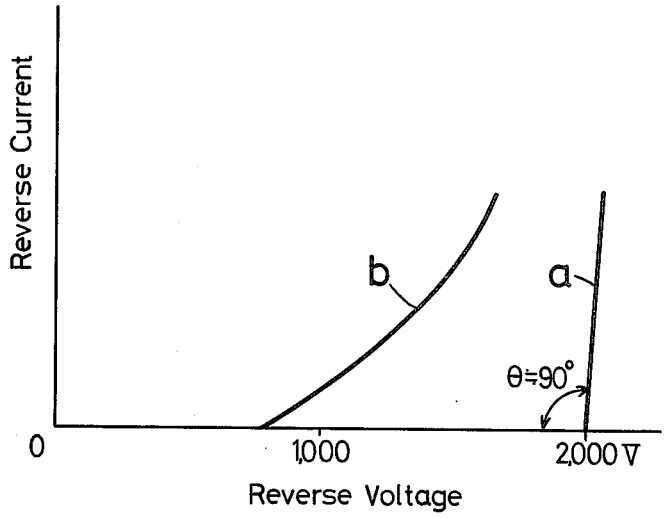
FIG. 2 shows characteristic of element employed in this invention.

Ignition coil 11, contains a secondary coil 12 having a resistance of about 10 kilo ohms wound around an iron core 13, and, further, a primary coil 11 having a resistance of several ohms wound on the secondary coil 12, both of which are insulated from each other and are connected by a lead wire at the ends of the coils to connect to the negative side of battery 3 through contact breaker 2. The contact breaker 2 is provided with the point 21 which is actuated by contact breaker cam 22. The point 21 is connected with condenser 23 of 0.2–0.25 microfared in parallel at the both ends of the contact breaker 2, which absorbs i.e., charges a high voltage of several hundred volts induced in primary coil 11 at discharge to render response rapid and to prevent sparking in the point 21. The positive side 3 having a battery of the rating voltage of 12 volts is connected to one end 14 of the primary coil and the negative side of the battery is connected to the other end 15 of the primary coil through the contact breaker 2, the lead wire between the negative side of the battery and the contact breaker 2 being connected to earth 7. Element 6 which can be an avalanche diode is reversely connected to the positive side 16, through which reverse current does not flow below 2,000 volts and which does flow suddenly at 2,000 volts, as shown by curve a in FIG. 2, when the point 21 of the contact breaker 2 turns to off from on. The other end of the avalanche 6 diode is connected to distributing arm 40 of distributor 4 which revolves, synchronized with the cam 22 of the contact breaker 2. The distributing arm 40 contacts with contact point 41 which is connected to earth 7 through a first ignition plug 51. The distributor 4 is provided with four contact points 41, 42, 43, and 44, being contacted with ignition plugs 51, 52, 53, 54 respectively, which are connected to earth 7 at the other end. The number of contact points of the distributor 4 is the same as the number of ignition plugs 5 and also equal to the number of cylinders. The distributing arm 40 revolves in the direction of arrow 45, synchronized with the revolution of the cam 22 in the direction of arrow 25.

When the point 21 of the contact breaker 2 turns to off from on, voltage at the positive side 16 of the secondary coil 12 is about to suddenly reach a high voltage of from 6,000 to 10,000 volts. However because the avalanche diode with rating value is 2,000 volts is connected reversely to the earth 7 through the distributor 4 and the ignition plug 5, positive current does not flow until 2,000 volts is achieved, but reverse current begins to flow suddenly at the moment when voltage exceeds 2,000 volts, as shown by curve a in FIG. 2, and reached sparking voltage Q1 to discharge, exceeding the minimum sparking voltage. After discharge, current which flows in he secondary coil becomes zero in a shorter time than the conventional ignition device c as shown by curve e in FIG. 5.

Figure 4:
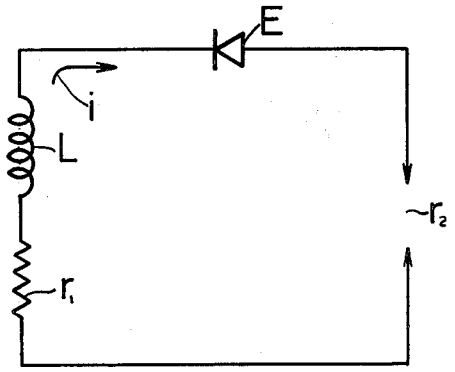
FIGS. 4 and 5 show a circuit and characteristic to describe this invention.

In FIG. 4, when L is the inductance of secondary coil, $R_1$ is the resistance of secondary coil, $R_2$ is the resistance of the plug at discharge, and E is the voltage of the avalanche diode.

$$(r_1 + r_2)\, i + L\frac{di}{dt} = -E$$

$$i = Io\ \exp(-\frac{(r_1 + r_2)}{L}\cdot t) - \frac{E}{r_1 + r_2}(1 - \exp(-\frac{r_1 + r_2}{L}\cdot t^{+}))^{1}$$

where i is instantaneous current, and Io is initial current at beginning of discharge. The above equation is plotted in FIG. 5.

Figure 5:
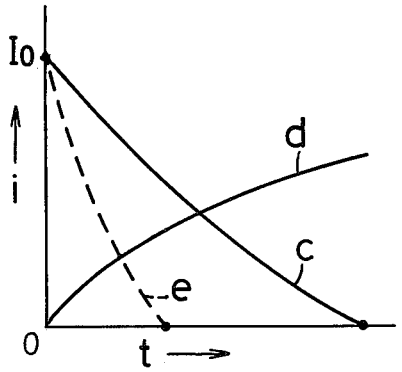

In FIG. 5, curve e represents the ignition device of this invention, and curve c represents the conventional ignition device.

Figure 3:
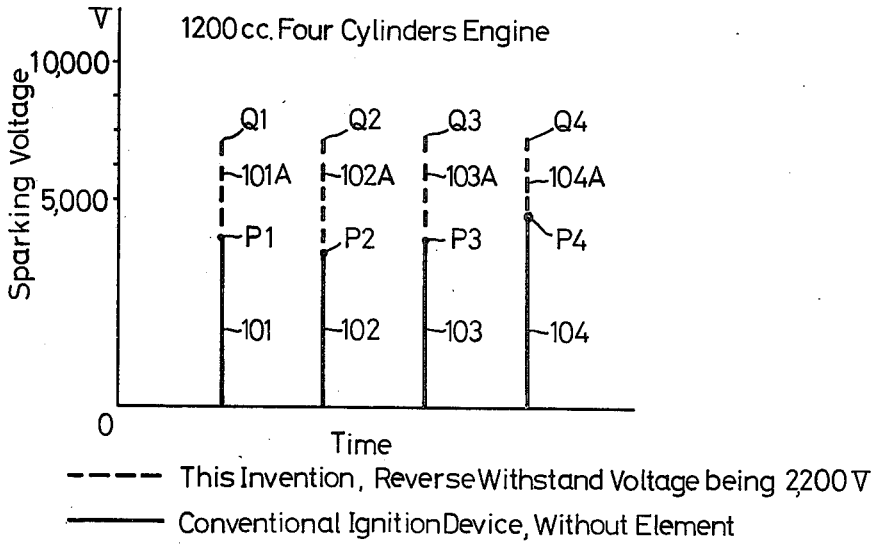
FIG. 3 shows sparking voltage-time relationship.

The above equation is calculated, as discharge resistance of plug 5 is invariable, but it practically varies from the beginning of discharge. However, because time constants of the first and second terms of the right side of the above equation vary equally, discharge ending time should shorter. The conventional ignition device is shown as curve c because it lacks the second term. The usual diodes which have such characteristic as to show response of reverse current according to increase in reverse voltage, as shown by curve b in FIG. 2, degrades remarkably and can not be used practically, if it is used instead of the element 6 of this invention. Sparking voltages of this invention which has the reverse rated avalanche diode withstand voltages of approximately 2,000 volts and have a measured value of about 2,200 volts, and of the conventional ignition device are measured by motorscope in 1,200 cc four cylinders engine, as shown in FIG. 3. Sparking voltage-time relationship of the conventional ignition device is shown by 101, 102, 103, and 104, with peak values and low, being about 5,000 volts vary as shown by P1, P2, P3, and P4. The relationship of this invention is shown by broken line 101A, 102A, 103A, and 104A, which peak values are high, being from about 7,200 to about 8,000 volts, increased by 3,200 volts of reversed withstand voltage of avalanche diode, and do not vary as shown by Q1, Q2, Q3, and Q4.

Ignition devices which employ diodes other than avalanche diode show almost the same peak value as that shown by solid line in FIG. 3, owing to internal loss of diode.

TABLE 1 gives experimental results, conducted on this invention and conventional ignition devices without avalanche diode 6. TABLE 1 indicates increase in torque and mileage.

TABLE 1.

Experimental Results Conducted On This Invention and Conventional Ignition Devices

| | This Invention 1 | | | This Invention 2 | | |
|---|---|---|---|---|---|---|
| Spead Km/hr | 40 | 60 | 80 | 40 | 60 | 80 |
| Kg.m | 20.0 | 18.5 | 20.0 | — | — | — |
| rpm | 1600 | 2300 | 2900 | 1580 | 2280 | 2900 |
| Km/1 | 12.8 | 12.5 | 11.0 | 12.8 | 12.75 | 11.0 |
| Second/20 ccc | 23.0 | 15.0 | 11.0 | 24.0 | 15.0 | 10.5 |
| | **This Invention 3** | | | **Conventional** | | |
| Spead Km/hr | 40 | 60 | 80 | 40 | 60 | 80 |
| Kg.m | 20 | 19 | 21 | 16.0 | 18.0 | 16.5 |
| rpm | 1580 | 2300 | 2920 | 1600 | 2350 | 2980 |
| Km/1 | 11.75 | 11.75 | 10.75 | 10.75 | 10.5 | 10.25 |
| Second/20 cc | 21.5 | 14.0 | 10.5 | 20.0 | 13.0 | 10.5 |
| | **This Invention** | | | **Conventional** | | |
| Spead Km/hr | 40 | 60 | 80 | 40 | 60 | 80 |
| Kg.m | 38.0 | 24.0 | 22.0 | 19.0 | 21.0 | 19.0 |
| rpm | 1500 | 2200 | 3000 | 1500 | 2200 | 3000 |
| Km/1 | 15.5 | 12.5 | 11.0 | 10.5 | 11.0 | 11.0 |
| Second/20 cc | 27.0 | 16.0 | 10.0 | 25.0 | 16.0 | 10.0 |

In this invention, element 6 such as avalanche diode is connected between distributor 4 and ignition coil 1, which begins to flow reverse current at voltage above the rated reverse voltage, when applied reverse voltage, to apply sparking voltage to gap of ignition plug 5. Sparking voltage increases by the rated reverse voltage i.e., reverse withstand voltage, has short residual sparking voltage time, and can ignite perfectly.

As a second embodiment illustrated in FIG. 6 element 6 (FIG. 1) is replaced by respective avalanche diodes 6 placed reversely between the connection, connecting together the earth sides of plugs 51, 52, 53, and 54, and earth 7, but distributor 4 should be insulated.

As a third embodiment illustrated in FIG. 7 element 6 (FIG. 1) is replaced by respectively avalanche diodes placed reversely between contact points 41, 42, 43, 44, which are the output terminals of distributor 4, and the corresponding plugs 51, 52, 53, 54. In this case, it is expensive and troublesome to attach the plugs, because the plugs are need by numbers of the cylinders, and, moreover, variation is recognized in response voltage of element 6.

As a fourth embodiment illustrated in FIG. 8, element 6 (FIG. 1) is replaced by an avalanche diode 6''' connected reversely between the point 17 and the ground 7.

In any embodiment, a plurality of elements 6 can be used, connected in series.

What is claimed is:

1. In an ignition device of an internal conbustion engine which includes an ignition coil having a primary winding and a secondary winding; a direct current source which applies current to the primary winding of the ignition coil; a breaker point which makes and breaks current of the primary winding from the direct current source; a cam which rotates, associated with rotation of a crankshaft of the internal conbustion engine, and opens and shuts the breaker point; a condenser connected across the breaker point; a distributor having a given plurality of contact points and a distributing arm which rotates associated with rotation of the cam; and a number of ignition plugs, corresponding in number to the contact points of the distributor, coupled with the secondary winding through respective ones of the contact points of the distributor; the improvment comprising at least one avalanche diode in series with each of said ignition plugs and an end of said secondary winding, said avalanche diode being connected in that direction wherein current produced from said secondary winding of said ignition coil is initially blocked from flowing to said ignition plugs until said avalanche diode breaks down at substantially the moment when said breaker points turns to OFF from ON.

2. An improved ignition device in accordance with claim 1, wherein said avalanche diode is connected between one end of said secondary winding and said arm of said distributor.

3. An improved ignition device in accordance with claim 1, wherein said at least one avalanche diode comprise a plurality of avalanche diodes, respective ones of these avalanche diodes being connected between each said contact point of said distributor and each said ignition plug.

4. An improved ignition device in accordance with claim 1, wherein said at least one avalanche diode comprises a plurality of avalanche diodes, respective ones of these avalanche diodes being connected between each of said ignition plugs and said ignition coil.

5. An improved ignition device in accordance with claim 1, wherein said avalanche diode is connected between one end of each ignition plugs and an end of said secondary winding of said ignition coil.

* * * * *